United States Patent [19]

Lessie

[11] Patent Number: 4,795,323

[45] Date of Patent: Jan. 3, 1989

[54] SCROLL MACHINE WITH ANTI-ROTATION MECHANISM

[75] Inventor: Stephen L. Lessie, Jamesville, N.Y.

[73] Assignee: Carrier Corporation, Syracuse, N.Y.

[21] Appl. No.: 115,327

[22] Filed: Nov. 2, 1987

[51] Int. Cl.[4] ..... F01C 1/04; F01C 21/00

[52] U.S. Cl. ..... 418/55; 74/86

[58] Field of Search ..... 418/55, 57, 61.3; 74/86; 464/104

[56] References Cited

U.S. PATENT DOCUMENTS 4,264,288 4/1981 Wusthof et al. ..... 418/61 B

FOREIGN PATENT DOCUMENTS 58-30403 2/1983 Japan ..... 418/55

*Primary Examiner*—John J. Vrablik

*Attorney, Agent, or Firm*—David J. Zobkiw

[57] ABSTRACT

The diameter of an orbiting scroll plate is increased and the periphery of the plate is notched or scalloped to clear the bolt bosses or spacers located between the fixed scroll and crankcase. The bolt bosses act as guides for the notches in the orbiting scroll plate to thereby create an anti-rotation mechanism. Because the anti-rotation structure is on the periphery of the plate, a greater thrust surface is available.

5 Claims, 3 Drawing Sheets

SCROLL MACHINE WITH ANTI-ROTATION MECHANISM

BACKGROUND OF THE INVENTION

In scroll compressors, the orbiting scroll must orbit without rotating and, in addition, is subjected to axial forces from the gas being compressed. A number of approaches have been developed for preventing rotation such as the Oldham coupling, balls moving in slots and rollers. The anti-rotation devices add structure to the scroll compressors.

Scroll compressors typically have an Oldham coupling between the orbiting scroll and the crankcase. This has two effects, it increases the height/length of the assembly and reduces the available thrust surface. In scroll compressors it is desirable to have a press fit motor so that the standard diameter of a motor defines the maximum diameter of the crankcase/pump assembly. To minimize cost it is necessary to use the smallest motor suitable for the job, but then it becomes necessary to provide the necessary thrust surface within the size constraints dictated by the motor. The present invention permits the use of a smaller motor while maintaining thrust surface requirements.

SUMMARY OF THE INVENTION

The diameter of the orbiting scroll plate is increased such that the maximum diameter of the orbiting scroll is greater than the minimum diametrical distance between the bolt bosses or spacers. Preferably the diameter of the orbiting scroll plate is the same as that of the circle locating the centers of the bolts. The scroll plate is notched with notches which are portions of a circle and whose number and location correspond to the number and location of the bolt bosses or spacers. Preferably the diameters of the bosses and the orbit are the same and are equal to the radius of the notches.

It is an object of this invention to provide a compact scroll anti-rotation mechanism.

It is another object of this invention to provide a large upper thrust surface area and to incorporate an anti-rotation mechanism into the orbiting scroll member. These objects, and others, as will become apparent hereinafter, are accomplished by the present invention.

Basically, an anti-rotation mechanism is integrated into an orbiting scroll. This is achieved by increasing the diameter of the scroll plate and notching or scalloping the periphery of the plate so as to clear the bolt bosses or spacers located between the fixed scroll and crankcase. With the bolt bosses acting as guides for the notches in the orbiting scroll plate, an anti-rotation mechanism is also created. Additionally, a large thrust surface is created on the orbiting scroll.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
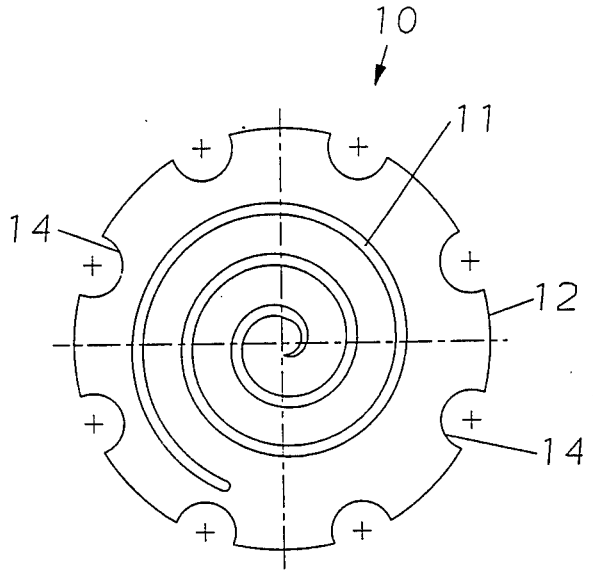
FIG. 1 is a top view of an orbiting scroll.
Figure 2:
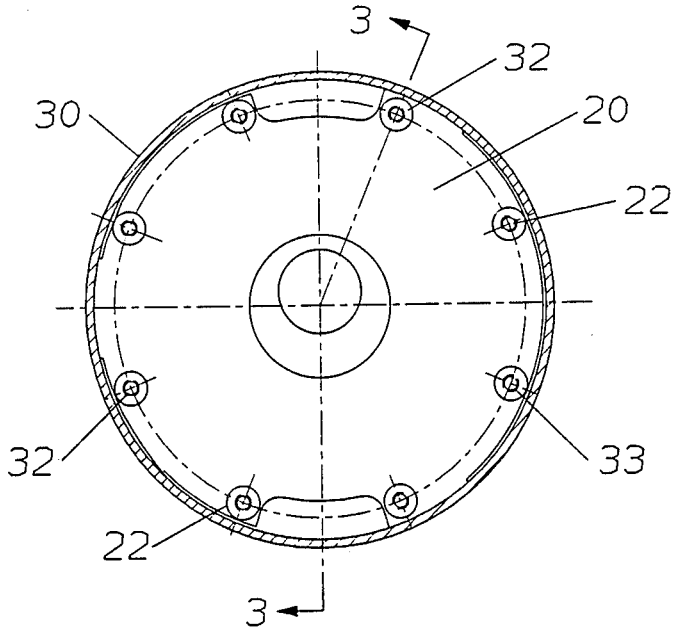
FIG. 2 is a top view of a crankcase.

In FIG. 1, the numeral 10 generally designates an orbiting scroll. Orbiting scroll 10 has a wrap 11 extending axially from plate 12. Plate 12 has a plurality of equally spaced notches or scallops 14 formed in its periphery. Referring now to FIG. 2, crankcase 20 is located in shell 30. A plurality of equally spaced threaded bolt holes 22 are formed in crankcase 20 and correspond in number to the notches 14. The bolt holes 22 are shown as overlain by cylindrical bolt bosses 32. Although bolt bosses 32 are illustrated as cylindrical, only the portion defining the surface engaging notches 14 needs to be cylindrical.

Figure 3:
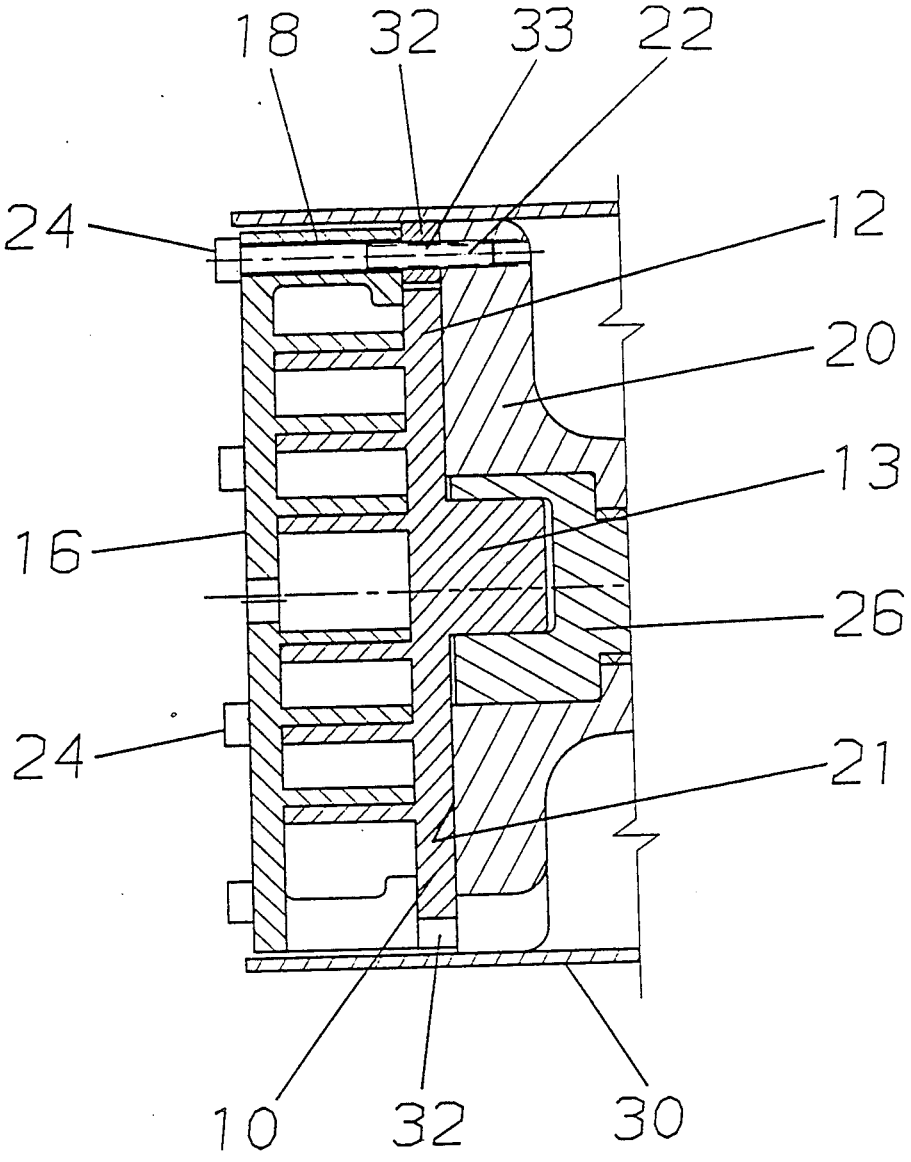
FIG. 3 is a sectional view through a portion of a compressor corresponding to a section through line 3—3 of FIG. 2.

As best shown in FIG. 3, fixed scroll 16 is secured to crankcase 20 by a plurality of equally spaced bolts 24 which serially extend through bolt bores 18 in fixed scroll 16, hole 33 in bolt boss 32 into threaded bolt holes 22 in crankcase 20. The diameter of plate 12 is equal to that of the bolt circle 25, shown in FIGS. 4–6, for bolts 24. The orbit diameter of the orbiting scroll 10 is preferably, but not necessarily, the same as the diameter of bolt bosses 32. Orbiting scroll 10 is driven by crankshaft 26 through pin 13 by a motor (not illustrated). Notches 14 are formed as portions of circles centered on the circumference of the plate 12 and of a radius equal to the combined radius of orbit of the orbiting scroll 10 and the radius of bolt boss 32. Thus, the centers of notches 14 and bolt holes 22 have the same angular spacing and are equal in number. From FIG. 3 it is clear that there is a large annular thrust surface area 21 between plate 12 and crankcase 20 which is uncompromised due to any anti-rotation structure.

Figure 4:
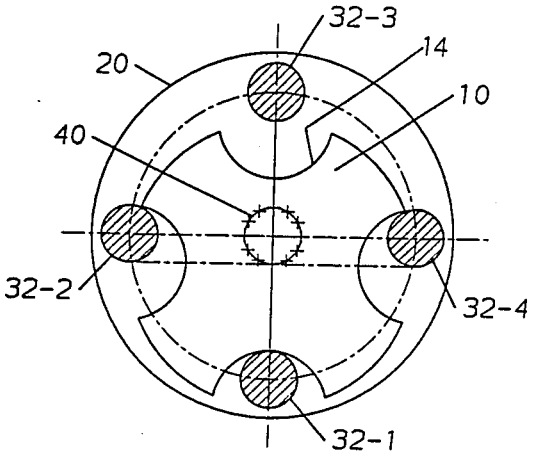
FIGS. 4—6 show sequential positions of the anti-rotation mechanism.
Figure 5:
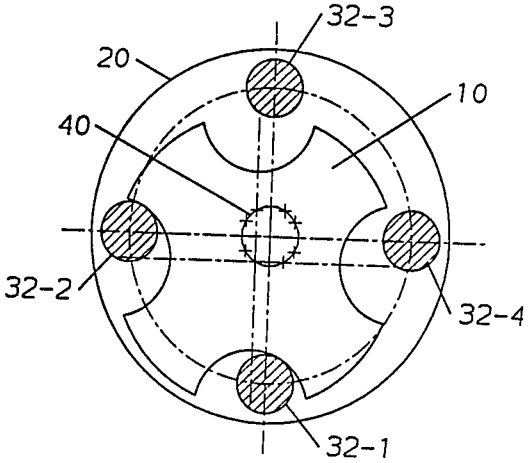
Figure 6:
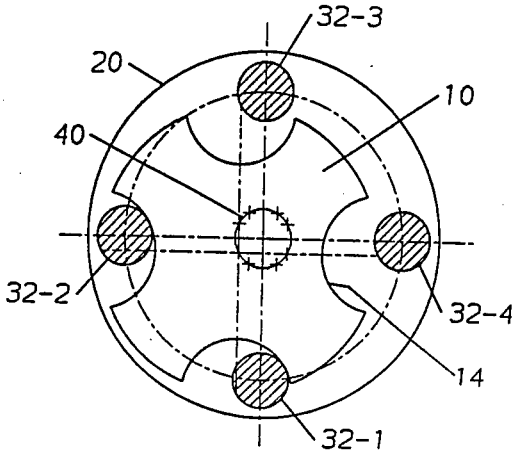

FIGS. 4–6 represent the serial relationship between the notches 14 of the orbiting scroll and the bolt bosses 32 at −30° crankangle intervals which repeat pictorially every 90° in the direction of orbiting and every 360° with respect to a specific bolt boss 32. For the sake of clarity only four notches 14 and bolt bosses 32 have been illustrated in FIGS. 4–6. The minimum number of uniformly spaced peripheral notches for smooth movement is four. Circular orbit 40 is traced by the center of orbiting scroll 10 and the cross marks on the circular orbit 40 represent positions corresponding to FIGS. 4–6 or spacings in multiples of 90° therefrom. In FIG. 4, orbiting scroll 10 which is orbiting in a clockwise direction, as illustrated, is in the middle of its contact with boss 32-1, is just completing contact with boss 32-4 and is starting contact with boss 32-2. In FIG. 5, which represents 30° of clockwise orbit form the FIG. 4 position, orbiting scroll 10 is just engaging bosses 32-1 and 2 with engagement with boss 32-1 well over half completed and engagement with boss 32-2 still in the early stages. FIG. 6 represents another 30° of clockwise rotation and, again, only bosses 32-1 and 2 are engaged but engagement with boss 32-1 is nearing completion. Another 30° of rotation would be the equivalent of rotating FIG. 4 clockwise 90° except that it would be contact with boss 32-1 which was being completed. Stated alternatively, the next sequence of −90° for boss 32-1 with respect to scroll 10, would be the same as that shown for boss 32-4 in FIGS. 4–6 and the following sequence of 90° would be the same as that shown for boss 32-3 in FIGS. 4–6. The next sequence of 90° would be the same as that shown for boss 32-2 in FIGS. 4–6.

Referring to FIGS. 1–3, it will be noted that the contact surface of plate 12 with crankcase 20 defines a thrust surface which is an annular area with pin 13 and circular notches 14 formed therein. Also, it will be noted that bolt bosses 32 are at the outer portion of crankcase 20 and the inner wall of shell 30 which places them at the greatest available radius. Referring specifically to FIGS. 4–6 it will be noted that the notches 14 define the only loss of available thrust surface. However, because the centers of the portions of a circle defining notches 14 are on the periphery of the orbiting scroll 10 and have a radius equal to the combined radius of the circular orbit 40 and the radius of bosses 32, the loss in thrust surface area is minimized and the available thrust surface is thereby maximized.

Although a preferred embodiment of the present invention has been illustrated and described, other changes will occur to those skilled in the art. For example, bosses 32 may be received in openings in the scroll plate rather than in notches or may be integral with the fixed scroll or crankcase or rollers on shoulder bolts. The spacing of the bosses and notches need not be uniform since the coaction of a boss is always with the same notch. So, the bosses may be non-uniformly spaced and have different curvatures so long as the corresponding notches have their radius changed accordingly since the radius of orbit would be the same. It is therefore intended that the scope of the present invention is to be limited only by the scope of the appended claims.

What is claimed is:

1. A scroll machine comprising:

a fixed scroll, an orbiting scroll, a crankcase and means for driving said orbiting scroll in a circular orbit all located within a housing with said fixed scroll secured to said crankcase with said orbiting scroll therebetween;

a plurality of spacer means located between said fixed scroll and said crankcase at a spaced angular distance on a circle centered on the axis of said scroll machine with each of said plurality of spacer means including a cylindrical portion;

a plurality of recesses formed in the periphery of said orbiting scroll corresponding in number and angular location to said plurality of spacer means to permit said orbiting scroll to fit between said plurality of spacer means;

each of said recesses being a portion of a circle centered on the periphery of said orbiting scroll and having a radius equal to the combined radius of said circular orbit and the radius of said cylindrical portion;

during motion of said orbiting scroll, at least two of said plurality of recesses always contacting the cylindrical portion of a corresponding number of said spacer means whereby said orbiting scroll moves in a circular orbit when driven by said means for driving.

2. The scroll machine of claim 1 wherein said plurality of spacer means is at least four.

3. The scroll machine of claim 1 wherein said orbiting scroll and said crankcase coact to define a thrust surface area radially inward of said spacer means and said recesses.

4. The scroll machine of claim 1 wherein said cylindrical portions have a radius of curvature corresponding to the radius of said circular orbit.

5. The scroll machine of claim 4 wherein the centers of said radii of curvature are centered on a circle equal in diameter to that of said orbiting scroll.

* * * * *